United States Patent [19]

Sekiya et al.

[11] Patent Number: 5,059,962

[45] Date of Patent: Oct. 22, 1991

[54] DISPLAY SYSTEM

[75] Inventors: Kazuo Sekiya, Tokyo; Yuichi Shiraishi, Yamato, both of Japan

[73] Assignee: International Business Machines Corporation, Armonk, N.Y.

[21] Appl. No.: 412,029

[22] Filed: Sep. 22, 1989

[51] Int. Cl.[5] ..... G09G 5/02

[52] U.S. Cl. ..... 340/793; 340/814; 340/717

[58] Field of Search ..... 340/723, 731, 728, 793, 340/814, 717; 358/455, 457

[56] References Cited

U.S. PATENT DOCUMENTS

| | | | |
|---|---|---|---|
| 3,937,878 | 2/1976 | Judice | 340/793 |
| 4,006,298 | 2/1977 | Fowler et al. | 340/793 |
| 4,558,370 | 12/1985 | Mitchell et al. | 340/793 |
| 4,855,728 | 8/1989 | Mano et al. | 340/717 |
| 4,937,677 | 6/1990 | Van Dorsselaer | 358/457 |

*Primary Examiner*—Alvin E. Oberley

*Assistant Examiner*—Amare Mengistu

*Attorney, Agent, or Firm*—Thomas P. Dowd

[57] ABSTRACT

A display system for converting first gray level signals of N bits/dot each, representing $2^N$ gray levels, to second gray level signals of M bits/dot each, representing $2^M$ gray levels, where N is an integer larger than or equal to 2 and M is an integer satisfying $N>M\geqq 1$, by separating each of the first gray level signals of N bits into higher M bits and lower N−M bits and respectively using the N−M bit values to select an appropriate table from among $2^{N-M}$ tables, each of which stores a distinctive set of P×Q modification values satisfying $P\times Q\geqq 2^{N-M}$, then respectively adding the M bits and each of the modification values of said selected table to generate P×Q second gray level signals, and supplying the resulting second gray level signals to a display device of $2^M$ gray levels. The first gray level signals may be supplied to a display device of $2^N$ gray levels having a smaller number of display dots than the display device of $2^M$ gray levels.

8 Claims, 4 Drawing Sheets

TABLES

| | 5<br>x=0<br>y=0 | 6<br>x=0<br>y=1 | 7<br>x=1<br>y=0 | 8<br>x=1<br>y=1 |
|---|---|---|---|---|
| VALUE OF M BITS =0 | 0 0<br>0 0 | 0 0<br>0 1 | 0 1<br>1 0 | 1 1<br>1 0 |
| VALUE OF M BIT =1 | 1 1<br>1 1 | 1 1<br>1 2 | 1 2<br>2 1 | 2 2<br>2 1 |
| VALUE OF M BIT =10 | 10 10<br>10 10 | 10 10<br>10 11 | 10 11<br>11 10 | 11 11<br>11 10 |
| VALUE OF M BIT =14 | 14 14<br>14 14 | 14 14<br>14 15 | 14 15<br>15 14 | 15 15<br>15 14 |
| VALUE OF M BIT =15 | 15 15<br>15 15 | 15 15<br>15 15 | 15 15<br>15 15 | 15 15<br>15 15 |

14

FIG. 4

DISPLAY SYSTEM

BACKGROUND OF THE INVENTION

1. Field of Invention

This invention relates to a display system for converting gray levels of a display device and, more particularly, to a display system for converting first gray level signals of N bits (N being an integer larger than or equal to 2) representing $2^N$ gray levels, to second gray level signals representing $2^M$ gray levels (M being an integer satisfying $N>M\geqq 1$).

2. Prior Art and Problem

In the prior art, a converting table has been used which has 64 entries, each of which stores 4 bits, for converting a gray level signal representing 64 gray levels to a gray level signal representing 16 gray levels. Due to its large size, the Table has not been included in a signal processing semiconductor chip but rather has been incorporated in a separate semiconductor chip. Further, an access time period of more than 50–100 nanoseconds is required to access the Table, resulting in low operational speed and increased costs.

SUMMARY OF THE INVENTION

The present invention converts first gray level signals of N bits/dot, which are supplied to a display device displaying $2^N$ gray levels/dot (where N is an integer larger than or equal to 2), to second gray level signals of M bits/dot (where M is an integer satisfying $N>M\geqq 1$). The second gray level signals are supplied to a display device which displays $2^M$ gray levels/dot. To perform the conversion, the invention includes: means for separating the first gray level signals of N bits into higher M bits and lower N−M bits; $2^{N-M}$ tables each of which stores P×Q modification values satisfying $P\times Q\geqq 2^{N-M}$ (where P and Q are natural integers); means for selecting one of the tables by using the N−M bits and, means for adding the M bits and each of the modification values of the selected table to generate P×Q second gray level signals. The number of display dots of the display device of $2^N$ gray levels is smaller than the number of display dots of the display device which displays $2^M$ gray levels. The gray levels include a real white level, a real black level, and plural intermediate levels therebetween.

BRIEF DESCRIPTION OF THE DRAWINGS

FIG. 4 shows the gray levels of the dots displayed on the display device 11 of FIG. 1.

DESCRIPTION OF THE PREFERRED EMBODIMENT

Figure 1:
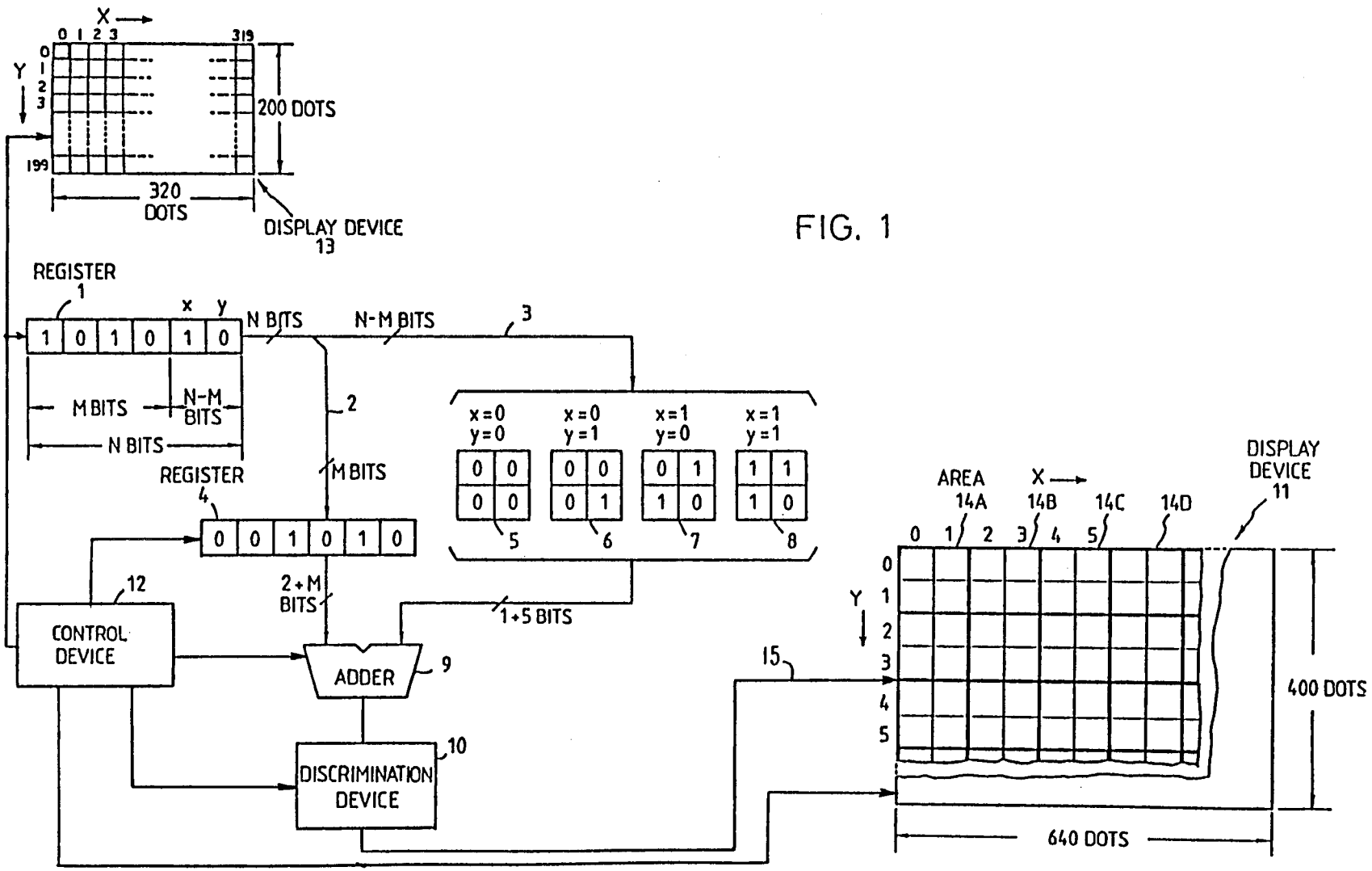
FIG. 1 is a diagrammatic representation of the components and circuit blocks of a display system in accordance with the present invention.

FIG. 1 shows a preferred embodiment of the invention. A first suitable display device 13 such as a CRT display device, for example, has a display surface of 200×320 pels or dots. Each dot displays $2^N$ gray levels, and a first gray level signal of N bits is used to represent the $2^N$ gray levels. N is an integer larger than or equal to 2.

Another suitable display device 11 such as a display device of the plasma display panel type, for example, has a display surface of 400×640 pels or dots Each dot displays $2^M$ gray levels, and a second gray level signal of M bits is used to represent the $2^M$ gray levels. M is an integer satisfying $N>M\geqq 1$.

In the invention, one dot of the display device 13 is converted to P×Q dots on the display device 11, where P×Q satisfies $P\times Q\geqq 2^{N-M}$, and P and Q are natural integers, P representing the number of horizontal dots and Q representing the number or vertical dots. $P\times Q>2^{N-M}$ means that a number of P×Q dots larger than or equal to $2^{N-M}$ gray levels is necessary to represent $2^{N-M}$ gray levels. The following table shows an exemplary relationship of the fractional N−M bits, $2^{N-M}$ gray levels, and P×Q dots.

TABLE 1

| N-M | $2^{N-M}$ | P × Q |
|---|---|---|
| 1 | 2 | 1 × 2, 2 × 1, 2 × 2 etc. |
| 2 | 4 | 2 × 2, 2 × 3 etc. |
| 3 | 8 | 3 × 3, 2 × 4 etc. |
| 4 | 16 | 4 × 4, 4 × 5 etc. |
| 5 | 32 | 6 × 6, 5 × 7 etc. |

For each first gray level signal of N bits, P×Q second gray level signals, each of which has M bits, are generated. In this exemplary embodiment, N=6 and M=4. That is, the display device 13 displays $2^N=2^6=64$ gray levels, and the display device 11 displays $2^M=2^4=16$ gray levels, and one dot of the display device 13 is converted to four dots on device 11, which dots are represented by $P\times Q\geqq 2^{N-M}$, (P=Q), i.e. $2^{6-4}=2^2=4$. Thus, the display area of device 11 can be subdivided into a set of square areas 14, each composed of four dots.

The circuit for performing the conversion, as shown in FIG. 1, includes: an N bit register 1; a 2+M bit register 4; $2^{N-M}$ tables 5, 6, 7 and 8; an adder 9; a discrimination device 10; and a control device 12. The control device 12 activates and controls the operations of the circuit components To simplify the drawing, the connecting lines among the control device 12, the registers 1,4, the tables 5–8, the adder 9, the discrimination device 10, and the display devices 11, 13, are diagrammatically shown. However, the details of these connections and the appropriate logic and functional components of the system will be readily understood and supplied by those of skill in the art in the light of the present description.

Each dot of the display device 13 displays 64 gray levels, and each of these 64 gray levels is represented by 6 bits, for example, as shown in the following Table 2.

TABLE 2

| Gray levels | 6 bit signal (First qray level signal) |
|---|---|
| 0 | 000000 |
| 1 | 000001 |
| 2 | 000010 |
| 3 | 000011 |
| . | . |
| . | . |
| . | . |
| 61 | 111101 |
| 62 | 111110 |
| 63 | 111111 |

Each dot of the display device 11 displays 16 gray levels, and each of the 16 gray levels is represented by four bits, as shown in the next Table 3.

TABLE 3

| Gray levels | 4 bit signal (Second gray level signal) |
|---|---|
| 0 | 0000 |
| 1 | 0001 |
| 2 | 0010 |
| . | . |
| . | . |
| . | . |
| 13 | 1101 |
| 14 | 1110 |
| 15 | 1111 |

Figure 2:
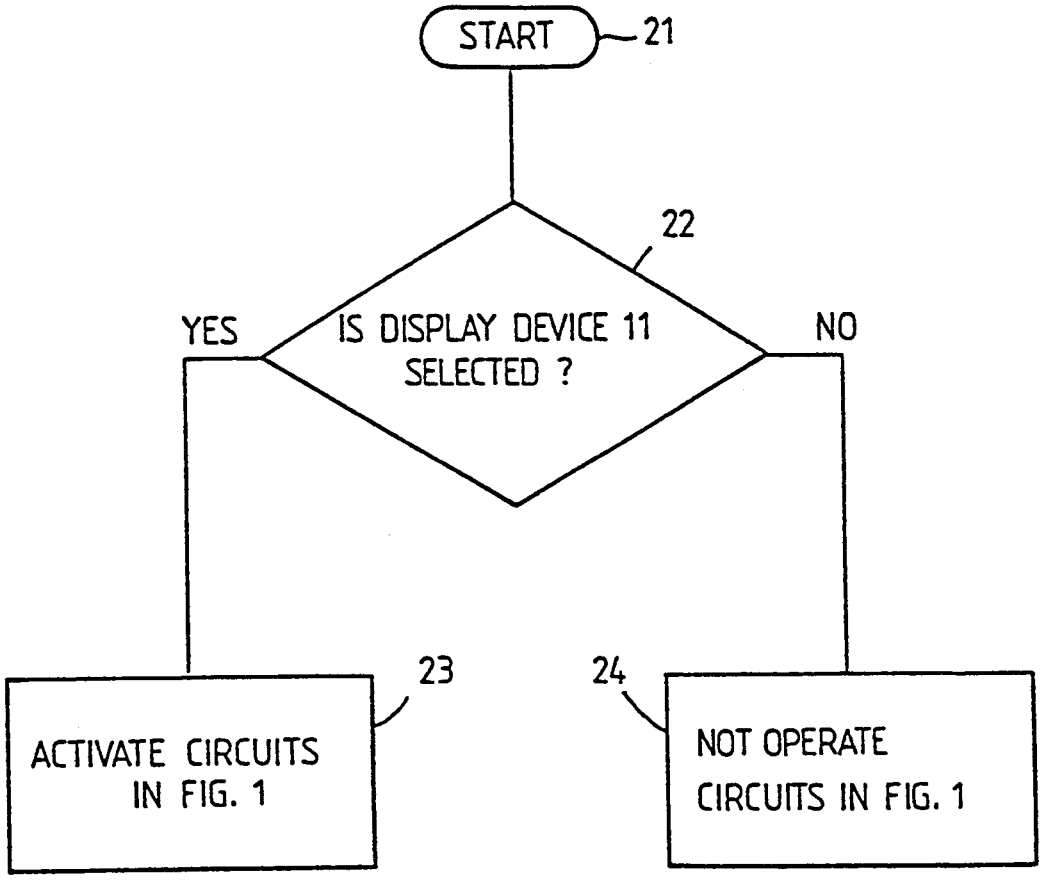
FIGS. 2 and 3 show flow charts of operations relating to the display system of FIG. 1.

The control device 12 may be a personal computer, for example, to which the CRT display device 13, displaying 64 gray levels/dot and having 200×320 dots, is connected as a standard attachment. The personal computer drives the plasma display device 11, displaying 16 gray levels/dot and having 400×640 dots, as an optional attachment. Accordingly, the control device 12 normally generates the 6 bit signals for the CRT display device 13, as shown in the Table 2, and responds to the fact that the plasma display device 11 has been selected by an operator, to activate the circuits of FIG. 1 to convert each of the 6 bit signals to four 4 bit signals. These operations are shown by blocks 22, 23 and 24 of FIG. 2, wherein if the answer from the block 22 is NO as to selection, the control device 12 does not activate the circuits of FIG. 1 (block 24).

The display device 13 has 400 scan lines and displays 200 dots in the vertical direction. That is, two scan lines are used to display one dot. For example, two horizontal scan lines are used to display a dot at position (X, Y)=(0, 0) of the display device 13 in FIG. 1, with the upper scan line being called OA and the lower scan line being called OB. The upper half of the dot is displayed by the upper scan line OA, and the lower half of the dot is displayed by the lower scan line OB, so that one dot is displayed for each two scans. Accordingly, the control device 12 generates the same signals during the scans of the upper and lower scan lines OA and OB.

Figure 3:
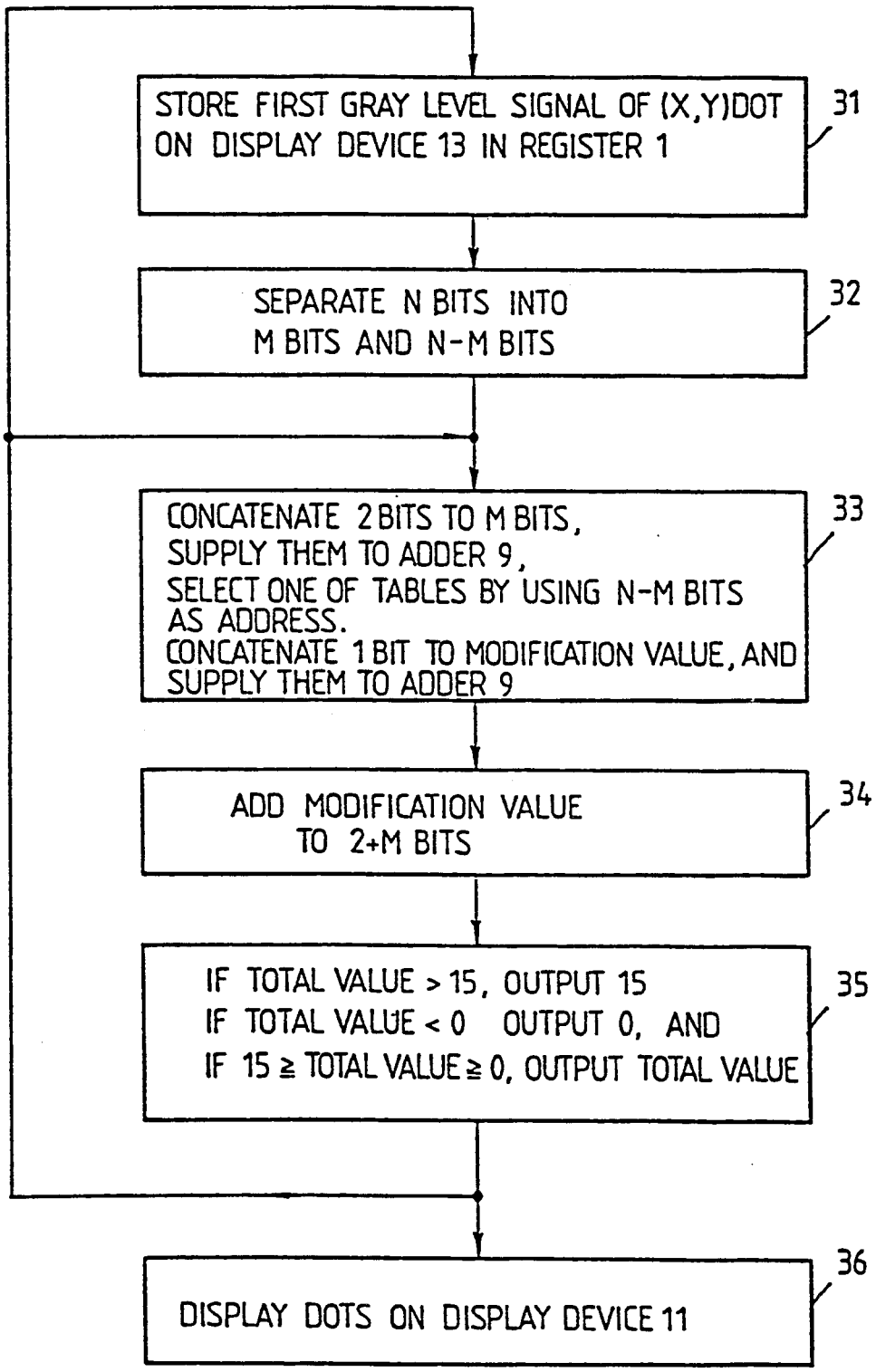

The operations of the block 23 (FIG. 2) will be described with reference to the flow chart of FIG. 3. To begin with, in block 31 in FIG. 3, the control device 12 generates a first gray level signal for the dot position (X, Y)=(0,0) of the display device 13, and stores it in the register 1. This operation of block 31 is repeated, that is, it is carried out twice, once for the upper scan line 0A and once for the lower scan line OB. The operation starts with the upper scan line OA. During the operating time taken for displaying the upper half of dot (0, 0) by the upper scan line AO, second gray level signals for the dots (0, 0) and (1, 0) of the display device 11 may be generated.

It will be assumed, for purposes of the description, that the control device 12 generates a first gray level signal 101010 (decimal value 42), which signal is stored in the register 1. Next, the control device 12, in block 32, supplies the higher 4 bits, i.e. M bits, 1010 of the 101010 signal into the lower 4 bit positions of the register 4 through the line 2. The higher 2 bit positions of the register 4 are always 0 0. The reason for concatenating the higher 2 bits in the register 4 will be described below. The control device 12, on the line 3, supplies the lower 2 bits, i.e. N−M bits, of the first gray level signal 101010 as an address to select one of the Tables 5, 6, 7 and 8 (block 33). The number of tables used is determined by $2^{N-M}$, so that in this embodiment 4 tables are prepared. The lower 2 bits are represented by x and y in FIG. 1. Since x=1 and y=0, the Table 7 is selected. Each table stores 4 modification values, i.e. P×Q, and each distinctive set of modification values corresponds to 4 dots of each of the areas 14A, 14B, 14C, 14D, etc. in display device 11. The modification values are represented in FIG. 1 by their decimal values, but as 0 corresponds to the binary value 00000 and 1 corresponds to the binary value 00001, these binary values are actually stored in the tables. Any value in the range from +15 to −15 is used as the modification value. From the viewpoint of fidelity, the preferred range is +3 to −3. The modification value has 5 bits representing +15 to −15, and a negative value is represented by the complement of 2. A single higher bit is concatenated to the 5 bits from the table by a sign extension. For example, in the case where the modification value is +1, 00001 is stored in the table, and 0 is concatenated to the 00001 by the sign extension, so that the input to the adder 9 from the table is 000001. In the case where the modification value in the table is −1, 11111 is stored in the table, 1 is concatenated to the 11111 by the sign extension, so that 111111 is supplied to the adder 9. Since the input to the adder 9 from the tables is 6 bits, the input from register 4 is also made to be 6 bits, so that it will be seen why the 2 leading 0 bits are concatenated in the register 4.

To generate a second gray level signal for the dot (0, 0) of the area 14A of the display device 11, the control device 12 first concatenates the bit 0 to the upper left modification value 00000 in the Table 7, and supplies the 000000 to the adder 9.

Next, the control device 12, in block 34, activates the adder 9 to add both the inputted bits from the Table and from the register 4. That is, the 000000 representing the upper left modification value 0 in the Table 7 is added to the 001010 (2+M bits), and the total value 001010 is generated.

The control device 12 operates to supply the total value 001010 to the discrimination device 10. The discrimination device 10 generates a signal on the output line 15 in accordance with the total value received. In particular, device 10 generates a signal corresponding to the value 15 (binary value 1111) on the output line, if the total value is larger than 15; generates 0 (binary value 0000) on the output line, if the total value is smaller than 0, that is, the total value is a negative value; and supplies the lower 4 bits of the total value on the output line, if the total value satisfies 15≧total value≧0 (block 35). To perform the discrimination, the upper 2 bits of the total value are determined or tested. When the most significant bit of the total value is 1, it indicates that the total value is negative. When the value of the higher 2 bits of the total value is 01, it indicates that the total value is larger than 15, and when the value of the higher 2 bits of the total value is 00, it indicates that the relation 15≧total value≧0 is satisfied. In the case of the upper left modification value in the Table 7, the total value is 001010, so that the 4 bits 1010 are supplied to the display device 11 as the second gray level signal for the dot (0, 0) in the area 14A, whereby a gray level of 10 (i.e. binary value 1010) is displayed at the dot (0, 0) of the display device 11.

Next, in order to generate a second gray level signal for the dot (1, 0) in the area 14A of the display device 11, the control device 12 reads out the upper right modification value 1 (binary value 00001) in the Table 7, converts it to the 6 bits 000001 by the sign extension, supplies those 6 bits to the adder 9 and supplies the 6 bits 001010 in the 2+M register 4 to the adder 9. Next, in the block 34, both of these values are added. The total value is 001011 and it satisfies 15≧total value≧0, so that the bits 1011 are supplied to the display device 11 as the second gray level signal for the dot (1, 0) in the area 14A, whereby a gray level of 11 (binary value 1011) is displayed at the dot (1, 0) of the display device 11.

The control device 12 performs the level conversion operation for the second dot (1, 0) in the dot line 0 of the display device 13, in the same manner, whereby the second gray level signals for the dots (2, 0) and (3, 0) in the area 14B of the display device 11 are generated and these dots are displayed. Similarly, the third dot and subsequent dots in the dot line 0 of the display device 13 may be converted, and two dots in the area 14C and the subsequent areas may be displayed. In this manner, the same image may be displayed on both of the display devices 11 and 13, while the number of gray levels and the number of dots of the display device 13 differ from that of the display device 11. As desired, both devices may be operated simultaneously or the display device 11 may be operated, while the display device 13 is not operated, and vice versa.

Next, the control device 12 starts the lower scan line OB of the dot line 0 of the display device 13 The same first gray level signals as that used for the upper scan line OA are used again to display the lower half of each dot in the dot line 0 of the display device 13, during which the second gray level signals for the dot line 1 of the display device 11 are generated. That is, the first gray level signal 101010 for the dot (0, 0) of the display device 13 is stored in the register 4 again (block 31 in FIG. 3).

And, in the described manner, the operations of blocks 32 and 33 are performed to select the Table 7. In this case, however, the lower left modification value 1 (00001) in Table 7 is read out, the sign extension is performed, and the value 000001 is added to the 6 bits 001010 of the register 4 in adder 9, so that the total value 001011 is supplied to the discrimination device 10. Since the total value 001011 satisfies 15≧total value≧0, the 4 bit second gray level signal 1011 representing the total value 001011 is used to display a gray level of 11 at the dot (0, 1) in the area 14A of the display device 11. Next, the operation returns to the block 33, the control device 12 reads out the lower right modification value 00000 in the Table 7, performs the sign extension to generate 000000, and supplies it to the adder 9. The adder 9 adds the value 000000 and the value 001010 of the register 4 to generate the total value 001010 (block 34). The total value 001010 is determined in the discrimination device 10 (block 35). Since the total value 001010 satisfies the condition 15≧total value≧0, the second gray level signal 1010 representing the total value is used to display a gray level of 10 (1010) at the dot (1, 1) in the area 14A of the display device 11.

It will be seen from the foregoing description that in this manner, from the first gray level signal of 6 bits (N bits) for one dot (0, 0) of the display device 13, second gray level signals for the four dots (0, 0), (1, 0), (0, 1) and (1, 1) in the area 14A of the display device 11, are generated.

FIG. 4 shows the gray levels of the second signals for the four dots in the various areas 14, generated for the noted value of the M bits, in the cases where the modification values in the Tables 5, 6, 7 and 8 are used. The gray levels described hereinbefore, are shown in the area 14 for x=1 and y=0 and the value of M bits=10. It will be apparent from the gray levels shown in FIG. 4, that when the value of the M bits=15, all the four dots become completely white, i.e. level 15. Accordingly, the four levels among the 64 first gray levels degenerate into one level of the second gray levels, so that 61 gray levels (16×4−3=61) are displayed on the display device 11. Larger P×Q values than $2^{N-M}$ could be used, and a proper combination of positive and negative modification values could be used, so that the number of degenerated levels is controlled.

In the described embodiment, by way of example the values N=6, M=4 and P=Q=2 were used. But, it will be appreciated that other values could also be used. The values shown in the Table 1 may be used as P and Q. Although the display devices 11 and 13 were described as a plasma display device and a CRT display device, respectively, other types of display devices, such as liquid crystal display devices, and electroluminescence display devices could be used. Also, by using other values as the modification values for the Tables 5, 6, 7 and 8, the characteristics of the gray levels displayed on the display device 11 could be varied.

Although the prior art has required a table of 64×4×4=1024 bit capacity to convert the signals representing the 64 gray levels to the signals representing the 16 gray levels, as described in the embodiment the invention only requires a table of 4×4×5=80 bit capacity In this manner, since the number of bits of the tables is small, the Tables 5, 6, 7 and 8 can be included in a signal processing semiconductor chip in accordance with the invention. The necessity of preparing the table in a separate semiconductor chip is avoided, whereby the required time period of more than 50–100 nanoseconds for accessing the table in a separate semiconductor chip is obviated. From this viewpoint, the invention increases the operational speed and decreases the cost.

Accordingly, it is possible to display the same image on different kinds of display devices which have different numbers of gray levels and different numbers of display dots. This enables and produces the following capabilities and applications. In the case of service businesses, such as banks and hotels, a receptionist and a customer can be facing each other with a low counter or table between them holding a display station, wherein the receptionist can view a first display device of the station while the customer faces another display device on the backside of the first display device, and it is required to prepare a display on the second device for the customer In this case, the lower gray level display device may be used by the receptionist, and the higher gray level display device is prepared for the customer. Both the receptionist and the customer see the same image on their display devices.

In accordance with the present invention, it is possible to display on the lower gray level display device an image of substantially the same gray levels as that of the higher gray level display device. In particular, as described in the embodiment, although the display device 11 displays only 16 gray levels for each dot, it is possible for the display device 11 to display 61 gray levels by using four dots for one dot of the display device 13 and displaying the image of the one dot of the display device 13 on the four dots on the display device 11.

We claim:

1. A display system for converting first gray level signals of N bits each, representing $2^N$ gray levels, to second gray level signals representing $2^M$ gray levels, where N is an integer larger than or equal to 2 and M is an integer satisfying $N>M\geqq 1$, said system comprising:

means for separating each of said first gray level signals of N bits into higher M bits and lower N−M bits;

$2^{N-M}$ tables each of which stores a distinctive set of P×Q modification values satisfying $P\times Q\geqq 2^{N-M}$;

means for selecting one of said tables using said N−M bits;

means for respectively adding said M bits and each of the modification values of said selected table to generate P×Q second gray level signals; and means for supplying said second gray level signals to a display device of $2^M$ gray levels.

2. A display system as in claim 1 further comprising means for supplying said first gray level signals to a display device which displays $2^N$ gray levels, and has a number of display dots smaller than the number of display dots of said display device of $2^M$ gray levels.

3. A display system for generating gray level signals capable of displaying the same gray level image on output display means having different numbers of gray levels and display dots, comprising:

means for generating first gray level signals, of N bits each, indicative of said gray level image and capable of producing a display representing $2^N$ gray levels on a first display means displaying $2^N$ gray levels, where N is an integer larger than or equal to 2; and converting means for generating second gray level signals, indicative of said gray level image and capable of producing a display representing $2^M$ gray levels on a second display means displaying $2^M$ gray levels, where M is an integer satisfying $N>M\geqq 1$, said converting means comprising:

means for separating said first gray level signals of N bits into higher M bits and lower N−M bits:

$2^{N-M}$ tables, each of which stores a distinctive set of P×Q modification values satisfying $P\times Q\geqq 2^{N-M}$;

means for selecting one of said tables using said N−M bits; and means for respectively adding said M bits to each of said modification values of said selected table to generate P×Q second gray level signals for producing a display on said second display means.

4. A display system as in claim 3 further comprising:

first display means for displaying $2^N$ gray levels;

second display means for displaying $2^M$ gray levels and having a number of display dots greater than the number of display dots of said first display means; and means for supplying said first gray level signals to said first display means and supplying said second gray level signals to said second display means.

5. A method for converting first gray level signals of N bits each, representing $2^N$ gray levels, to second gray level signals representing $2^M$ gray levels, where N is an integer larger than or equal to 2 and M is an integer satisfying $N>M\geqq 1$, said system comprising the steps of: separating each of said first gray level signals of N bits into higher M bits and lower N−M bits;

creating $2^{N-M}$ tables, each of which stores a distinctive set of P×Q modification values satisfying $P\times Q\geqq 2^{N-M}$;

selecting one of said tables using said N−M bits;

respectively adding said M bits and each of the modification values of said selected table to generate P×Q second gray level signals; and supplying said second gray level signals to a display device of $2^M$ gray levels.

6. A method as in claim 5 further comprising the step of supplying said first gray level signals to a display device which displays $2^N$ gray levels, and has a number of display dots smaller than the number of display dots of said display device of $2^M$ gray levels.

7. A method for generating gray level signals capable of displaying the same gray level image on output display means having different numbers of gray levels and display dots, comprising the steps of:

generating first gray level signals, of N bits each, indicative of said gray level image and capable of producing a display representing $2^N$ gray levels on a first display means displaying $2^N$ gray levels, where N is an integer larger than or equal to 2; and generating second gray level signals, indicative of said gray level image and capable of producing a display representing $2^M$ gray levels on a second display means displaying $2^M$ gray levels, where M is an integer satisfying $N>M>1$, by the steps comprising:

separating said first gray level signals of N bits into higher M bits and lower N−M bits;

creating $2^{N-M}$ tables, each of which stores a distinctive set of P×Q modification values satisfying $P\times Q\geqq 2^{N-M}$;

selecting one of said tables using said N−M bits; and respectively adding said M bits to each of said modification values of said selected table to generate P×Q second gray level signals for producing a display on said second display means.

8. A method as in claim 7 further comprising the step of supplying said first gray level signals to said first display means and supplying said second gray level signals to said second display means.

* * * * *

UNITED STATES PATENT AND TRADEMARK OFFICE

CERTIFICATE OF CORRECTION

PATENT NO. : 5,059,962

DATED : October 22, 1991

INVENTOR(S) : SEKIYA et al.

It is certified that error appears in the above-identified patent and that said Letters Patent is hereby corrected as shown below:

On the title page: Item

[30] Foreign Application Priority Data

September 22, 1988 [JP] Japan.....63-236,291

Signed and Sealed this

Twentieth Day of April, 1993

*Attest:*

MICHAEL K. KIRK

*Attesting Officer*

*Acting Commissioner of Patents and Trademarks*